US006457689B1

(12) United States Patent
Padiak et al.

(10) Patent No.: US 6,457,689 B1
(45) Date of Patent: Oct. 1, 2002

(54) SIGN SUPPORT HAVING OFFSET PIVOT

(75) Inventors: Scott Padiak, Winnetka, IL (US); Thomas M. Conway, Chicago, IL (US)

(73) Assignee: Cormark, Inc., Elk Grove, IL (US)

( * ) Notice: Subject to any disclaimer, the term of this patent is extended or adjusted under 35 U.S.C. 154(b) by 0 days.

(21) Appl. No.: 10/044,380

(22) Filed: Jan. 11, 2002

(51) Int. Cl.[7] ..... E04G 3/00

(52) U.S. Cl. ..... 248/291.1; 40/492; 40/642.02; 40/651; 248/214; 248/231.41; 248/240

(58) Field of Search ..... 248/231.41, 228.2, 248/291.1, 220.41, 311.2, 213.1, 206.5, 228.4, 205.1, 205.3, 214, 309.4, 235, 240, 250; 40/492, 642.02, 651, 658, 661.03

(56) References Cited

U.S. PATENT DOCUMENTS

| | | | | | |
|---|---|---|---|---|---|
| 629,021 | A | * | 7/1899 | True | 248/291.1 |
| 1,199,848 | A | * | 10/1916 | Willoughby | 211/12 |
| 4,821,437 | A | * | 4/1989 | Abramson et al. | 40/651 |
| 4,884,351 | A | * | 12/1989 | Abramson | 40/606 |
| 5,230,174 | A | * | 7/1993 | Reed | 116/303 |
| 5,408,775 | A | * | 4/1995 | Abramson et al. | 24/580.11 |
| 5,803,420 | A | * | 9/1998 | Conway et al. | 248/231.41 |
| 5,924,367 | A | * | 7/1999 | Henke et al. | 108/108 |
| 5,934,633 | A | * | 8/1999 | Padiak et al. | 248/214 |
| 6,108,956 | A | * | 8/2000 | Conway et al. | 248/220.41 |

* cited by examiner

*Primary Examiner*—Anita King
*Assistant Examiner*—Tan Le
(74) *Attorney, Agent, or Firm*—Welsh & Katz, Ltd.

(57) ABSTRACT

A sign support system supports a graphic from a storage rack that has upper and lower horizontal support members that define a first plane. The sign support system includes a mounting member for mounting to the lower horizontal support member. The mounting member has a shelf mount and hinge portion and is configured such that when the mounting member is mounted to the lower support member, the hinge portion is displaced from the first plane. An elongated arm has a hinge portion and a graphic support terminating at a free end. The hinge portion is configured for pivotally mounting to the mounting member for pivoting the sign between first and second positions. Adhering elements are disposed on the elongated arm at about the free end. When in the first position, the free end is disposed adjacent the upper horizontal support member with the adhering elements engaging the upper support member securing the arm in the second position. When the adhering member is disengaged from the upper support member, the arm hinge portion is disposed between the mounting member and a vertical line extending from a center of gravity of the sign such that sign falls to the second position by the force of gravity.

30 Claims, 3 Drawing Sheets

SIGN SUPPORT HAVING OFFSET PIVOT

BACKGROUND OF THE INVENTION

The present invention is directed to a pivoting sign system. More particularly, the present invention is directed to a pivoting sign system having a support with an offset pivot.

Point of purchase or display sign systems can be tremendously effective marketing tools. As such, the sign systems have become widely popular on all manner of retail and commercial trades.

Various types of sign systems and displays are available in a wide variety, including active signs which may rotate or have other moving elements, to the more traditional passive stationary signs, such as overhead signs. Although many of these types of signs will be well recognized in the traditional, retail setting, they are also becoming popular for use in the fast-growing home improvement center retail market as well as large warehouse-club types of establishments. For example, many home improvement and warehouse-club establishments use conventional warehouse-type stocking arrangements. One such arrangement includes a shelving system that can accept loaded pallets and palletized items on to shelves. Although these pallet receiving arrangements, commonly referred to as pallet racks, provide an efficient means for stocking and storing items, they may not lend themselves to mounting conventionally known signs or display systems.

In addition to providing effective, eye-catching advertising displays, these sign systems must also be designed to permit movement or removal of the sign system so that the shelves can be efficiently restocked, without tremendous manipulation of the sign, or damage to the sign systems, more specifically, the sign supports. This is particularly so in that large amount of stock can be placed on these shelves and may require frequent access. In addition, because the quantity of material that can be stored or stocked on these shelves is so large, it may be necessary to use forklifts and the like to gain access to these shelves.

Conway et al., U.S. Pat. No. 5,803,420, which patent is commonly assigned herewith, discloses one effective sign mounting system that permits pivoting the sign to obtain access to the shelves on which the sign is mounted. While this is an effective sign system, there may be times when the configurational layout of these pallet racks would lend itself to more easily securing the sign in an upward or downward orientation.

Accordingly, there is a need for a sign and mounting system that permits the use of large, advertising-effective media displays, which signs and mounting systems readily permit securing the sign into an upward or downward position. Desirably, such a sign system utilizes magnetic elements to secure the sign in an upward orientation. Most desirably, such a sign system includes an offset pivot so that once the magnet is disengaged, the sign will fall, by gravity to the downward orientation.

BRIEF SUMMARY OF THE INVENTION

A sign support system is for use with an associated storage rack having upper and lower horizontal support members, such as a pallet rack. The support members define a first plane and the sign mounting system is configured for mounting a sign to the rack.

The system includes a mounting member for mounting to the lower horizontal support member. The mounting member has a shelf mount and a hinge portion. The mounting member is configured such that when the mounting member is mounted to the lower horizontal support member, the hinge portion is displaced from (i.e., forward of) the first plane defined by the support members.

An elongated arm has a hinge portion and a graphic support portion that terminates at a free end. The hinge portion is configured for pivotally mounting to the mounting member for pivoting the sign between first and second (e.g., upper and lower) positions. Adhering elements, preferably magnetic elements, are disposed on the elongated arm at about the free end.

When in the first position, the free end is disposed adjacent the upper horizontal support member and the magnetic elements engage the upper horizontal support member to secure the arm in the upper position. When the magnetic elements are disengaged from the upper horizontal support member, the arm hinge portion is disposed between the mounting member and a vertical line extending from a center of gravity of the sign such that sign falls to the lower position by the force of gravity.

A preferred sign support system includes a pair of mounting members and a pair of elongated arms, each of the pair of mounting members associated with one of the pair of arms, and transverses support members extending between the elongated arms to support the edges of the associated graphic.

A current mounting member is formed as an L-shaped bracket defining the shelf mount. Each mounting member has a face portion and a rest portion and defines a juncture between the face and the rest. The hinge portion extends from about the juncture.

Preferably, each elongated arm includes a flexible connecting portion that extends between and connects the hinge portion and the graphic support portion. The hinge portion can include a cut-out region defining a portion of the flexible connecting portion. The hinge portions can include first and second flexing stops and a pivot stop.

In one configuration, the elongated arm has a variable length. Exemplary of variable length configuration is a telescopic configuration. Fasteners can be used to secure the elongated arm at a desired length.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
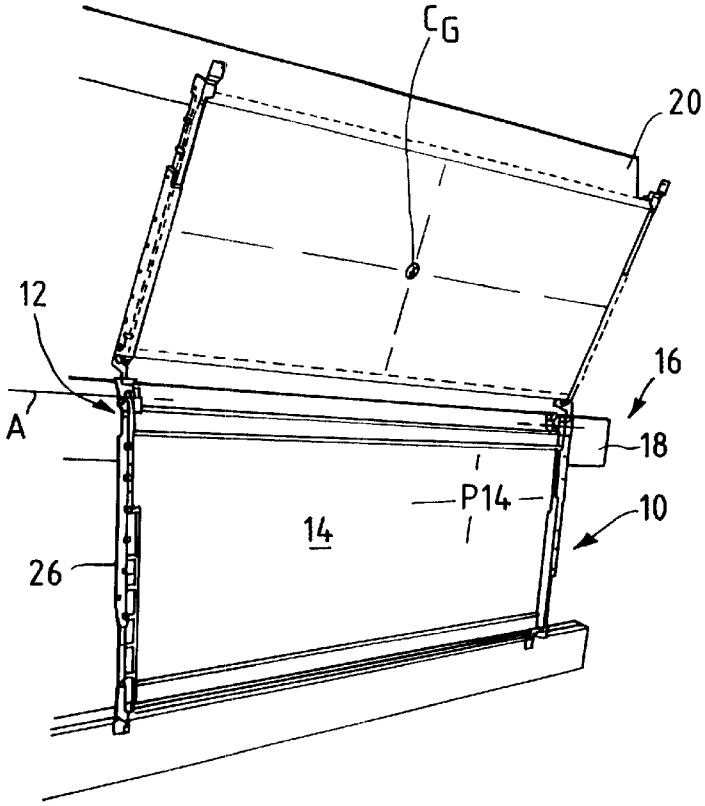
FIG. 1 is a perspective view of a sign system showing the sign in solid lines in a downward or shelf-access orientation, and showing the sign pivoted upward in phantom lines, to illustrate the media display orientation.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring to the figures and in particular to FIG. 1, there is shown a sign support system 10 having an offset pivot, indicated generally at 12, embodying the principles of the present invention. The sign support system 10 is used for supporting a sign or indicia containing graphic 14, as will be well recognized by those skilled in the art. Typically, such a graphic 14 is a relatively thin planar member made of cardboard, thin polymer sheet material or the like.

The sign support system 10 is mounted to a commonly known shelving system, one type of which is referred to as a pallet rack. An exemplary pallet rack, generally indicated at 16, includes horizontal beams or shelves 18, 20 supported by a plurality of vertical posts or risers (not shown). The shelves or beams 18, 20 are typically spaced at known intervals from one another. To this end, the space or distance between horizontal beams or shelves 18, 20 will be of standard or known dimensions.

Figure 7A:
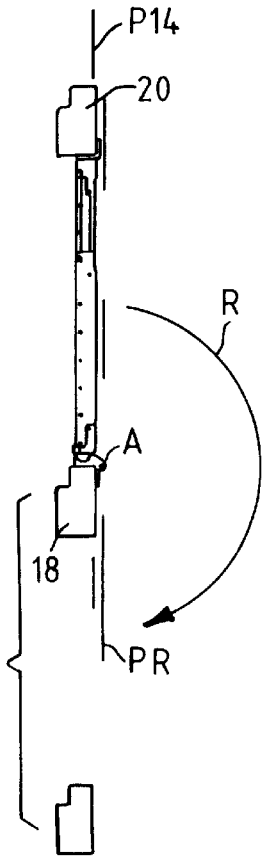
FIGS. 7A and B illustrate the simple use of the sign pivoting between the media display position as shown in FIG. 7A and the shelf access or stocking position as shown in FIG. 7B.
Figure 7B:
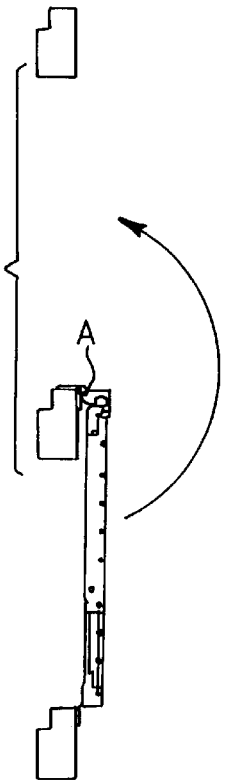

The sign support system 10 is configured to mount between shelves or beams 18, 20 so that the supported graphic 14 can pivot between a display position, such as that shown in phantom lines in FIG. 1 and illustrated schematically in FIG. 7A, and a stocking or storage orientation, as shown in solid lines in FIG. 1 and illustrated schematically in FIG. 7B. These orientations may be referred to as the display, upper or first positions, and the storage (stocking), lower or second positions, respectively. Those skilled in the art will, however, recognize that in use of the present sign system, these two positions can be reversed, that is with the second position or downward orientation (as illustrated in FIG. 7B) serving as the display position, and the first position or upward orientation (illustrated in FIG. 7A) providing the storage or stocking position.

Figure 3:
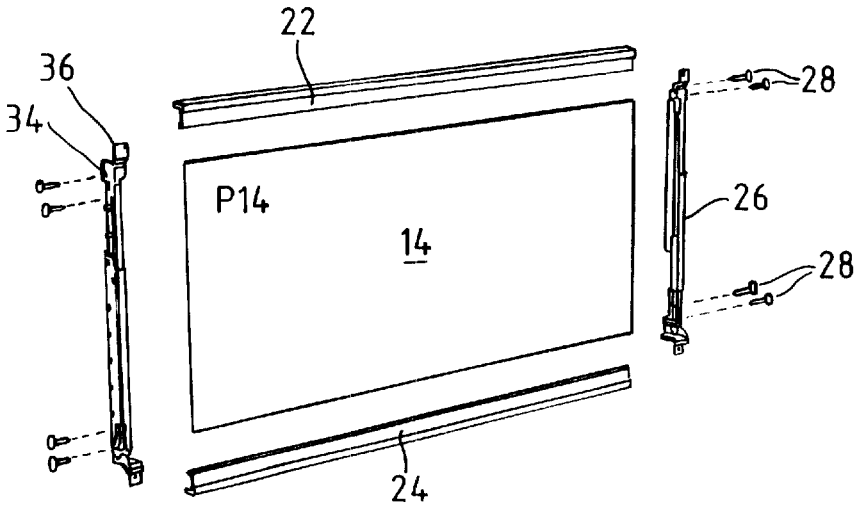
FIG. 3 is an exploded view of the sign showing the indicia containing graphic portion, upper and lower extrusion arms and left and right support arms having an offset pivot.
Figure 4:
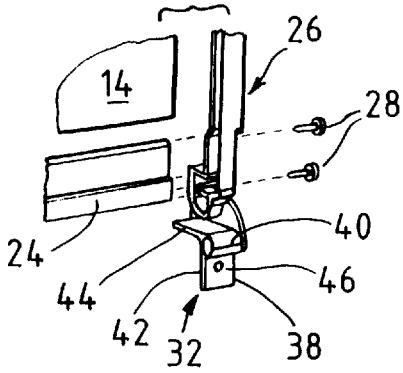
FIG. 4 is an enlarged view of the pivot portion of the sign support.

The sign system includes the graphic 14, as described above, upper and lower transverse elements 22, 24 (currently extruded elements) that support the graphic at upper and lower, i.e., horizontal, edges, and pivoting support arms 26. When fully constructed, as shown in FIG. 3 (in which an exploded view is provided) the transverse elements 22, 24 are secured to the arms 26 by a plurality of fasteners 28 and the graphic 14 is "sandwiched" between the support arms 26 and transverse elements 22, 24.

Figure 2:
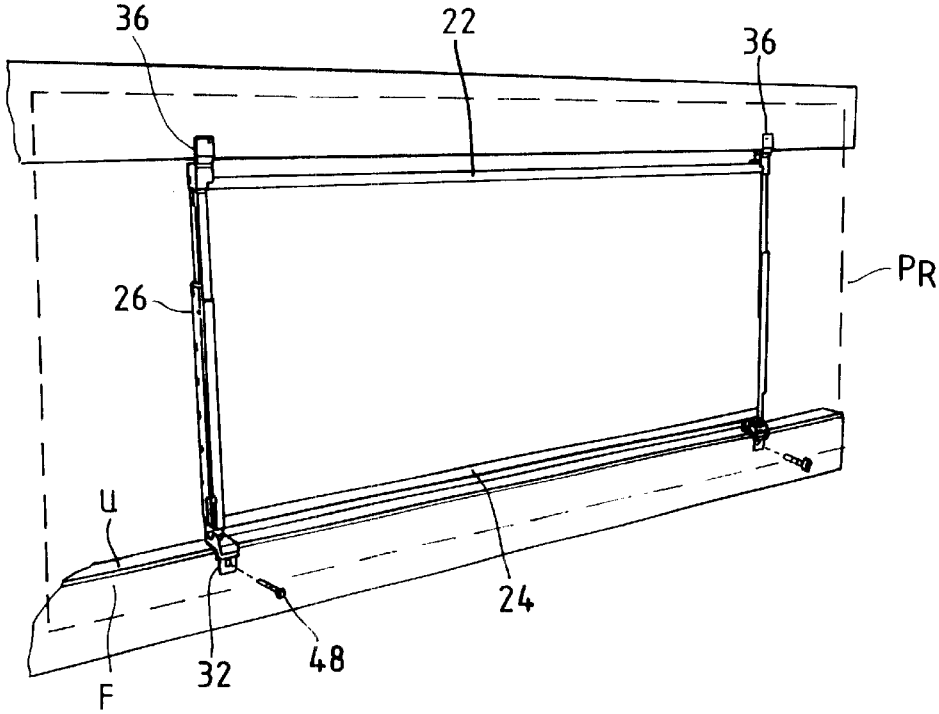
FIG. 2 is a perspective illustration of the sign system in the fully upwardly pivoted or display position, in which the magnetic elements secure the sign to an above shelf beam.

Each support arm 26 includes an elongated arm member 30 and a mounting member 32. The arm members 30 each terminate at a free end 34. In a preferred embodiment, as will be described below, the free ends 34 includes an adhering element 36, such as the illustrated magnetic element so that when the arm member 30 is positioned upwardly (or rotated upwardly as seen in FIGS. 2 and 7A) the magnetic elements 36 will secure to an upper shelf beam 20 to secure the graphic 14 in that upward orientation.

The mounting member 32 includes, generally, a shelf mount 38 and a hinge pintle 40. In a current embodiment, the shelf mount portion 38 is configured as an "L" shaped bracket having a face portion 42 and a rest portion 44. As illustrated, the face portion 42 is configured to abut a front surface F of the rack lower shelf or beam 18 and the rest portion 44 is configured to rest on an upper surface U of the shelf or rack beam 18. As such, the "L-shaped" bracket conforms to the top surface U and face F of the shelf or beam 18. The bracket face surface 42 can include an opening 46 therein to permit readily fastening the member 32 to the beam 18 such as by bolts, screws or the like 48.

The hinge pintle 40 is configured such that the axis A about which the arm 30 and graphic 14 pivots is forward of the front F of the beam or shelf 18, and offset from the face of the graphic 14. That is, the pintle 40 is located forward of a plane $P_R$ defined by the rack beams 18, 20 and forward of a plane $P_{14}$ defined by the graphic 14.

Figure 5:
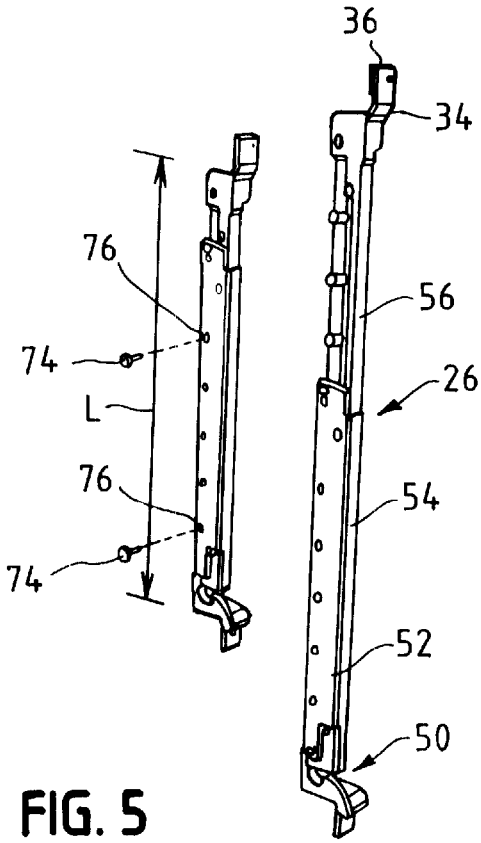
FIG. 5 illustrates one exemplary support arm configured for telescoping to permit use with signs of various sizes.
Figure 6:
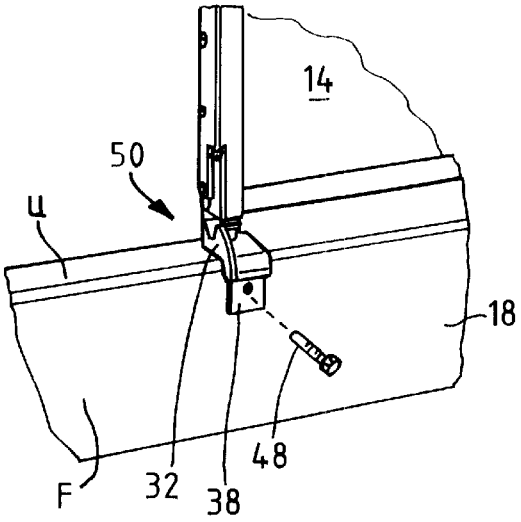
FIG. 6 illustrates the exemplary sign support pivot region showing one manner of mounting the sign support to the pallet rack beam.
Figure 8:
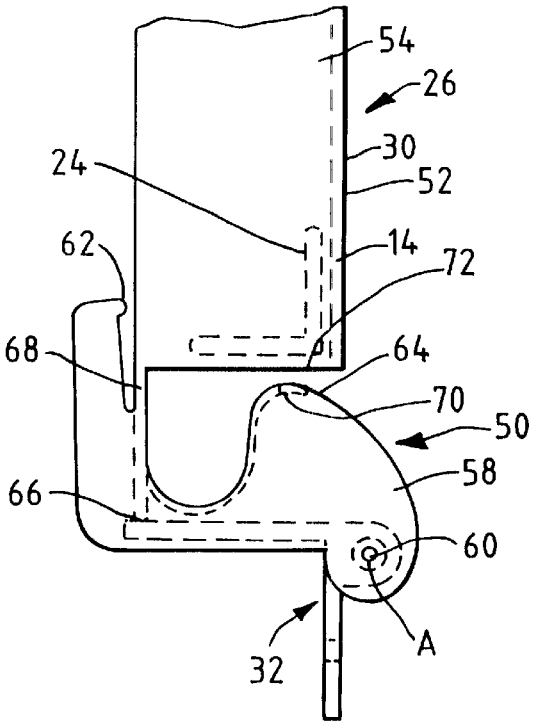
FIG. 8 is an enlarged, partial view of the arm hinge portion and the shelf mount.

Referring now to FIGS. 5 and 8, it will be seen that the elongated arm member 30 includes a hinge portion 50 and a graphic support portion 52. The hinge portion 50 is configured for pivotally connecting the arm member 30 to the shelf mounting member 32. The support portion 52, as described below, can include telescoping sections 54, 56 that permit a variety of attachment configurations. As best seen in FIG. 8, the hinge portion 50 includes a main body portion 58, a pivot 60, first and second flexing stops 62, 64, a pivot sop 66 and a relatively resilient or flexible connecting element 68 extending between the main body 58 and the graphic support portion 52. The resilient connecting portion 68 permits flex, or provides "play" between the graphic support 52 and the hinge portion 50. As such, the support portion 52 can be urged rearwardly (more toward the upward orientation), with minimal resistance to assure proper engagement of the magnetic elements 36 with the upper beam 20. In this manner, the sign 10 can be urged farther than (e.g., beyond) the resting position, thus placing a small amount of stress at the connecting portion 68, while still assuring proper securing of the sign 10 to the upper beam 20 in the upward orientation, and structural integrity of the connector 68.

The first or rearward flexing stop 62 prevents "over-flexing" the sign 10 (that is, the arm 30 and graphic 14) rearward which could otherwise overstress the connector 68. The second or forward flexing stop 64 prevents "over-flexing" the sign 10 and the connector 68 forward, which could also, otherwise, overstress the connector 68. In a current embodiment, the forward flexing stop 64 is formed as a shoulder 70 on the main body 58. The shoulder 70 is configured to cooperate with an end 72 of the support arm 30 so that when the sign 10 is "pulled" forwardly, the arm end 72 can engage the shoulder 70, to provide leverage for disengaging the magnetic elements 36 from the beam 20, as well as preventing over-flexing the connecting portion 68.

To accommodate the flexible connecting portion 68, the base or body 58 of the hinge portion 59 includes a recess or cutout region 74. This configuration facilitates elongation of the connecting portion 68 thus enhancing function of the flexible design.

As will be appreciated by those skilled in the art, mounting the sign system 10 to the beams 18, 20 is relatively straightforward. The sign 10 is held with the mounts 38 against the beam 18 and is secured thereto. The mounts 38 can be fastened by, for example, fasteners 48 that are driven through the openings 46 in the face portion 42 and into the beam 18. Alternately, the mounts can be secured to the beam 18 by straps (e.g., wire ties) and the like. The arm 30 and graphic 14 can then be pivoted from the upward orientation to the downward orientation.

As set forth above, the elongated arm members 30 have a telescopic configuration. This permits use of the present sign support system 10 with graphics 14 having differing heights (that dimension L along the length of the arm member 30). This further permits use of the sign system 10 on pallet racks 16 having differing heights between the horizontal shelves or beams 18, 20. Thus, graphics 14 can be prepared and sized and the sign support system 10 can be adjusted to accommodate a desired size to assure that the magnetic elements 36 rest securely on an upper rack beam or shelf 20.

Referring to FIG. 5, the arm member 30 length L is readily adjusted by positioning one section 56 of the arm 30 relative to the other section 58. Fasteners 74 can then be inserted into appropriate openings 76 in the arm sections 56, 58 to lock the sections 56, 58 to desired position, e.g., length L.

Referring now to FIGS. 7A and 7B, it will be readily appreciated that the pintle 40 and axis A lie outside of the plane $P_{14}$ that is defined by the graphic 14, e.g., the area bounded by the arms 26 and the transverse members 22, 24. More particularly, the pivot axis A is forward of this plane $P_{14}$. As such, because the pivot axis A is spaced forwardly of this plane $P_{14}$ in the direction of rotation of the sign 10, as indicated by the arrow at R in FIG. 7A, once the magnetic elements 36 are disengaged from the upper shelf or beam 20, the gravitational force acting on (the center gravity $C_g$ of) the arms 30 and graphic 14 (or those portions of the sign that rotate), pivots the arms 30 and graphic 14 downwardly to the downward orientation. Thus, in order to reposition the sign 10 from the upward or display position, to the downward or storage position, it is necessary only to disengage the magnetic elements 36 from the upper beam 20 and allow the sign 10 to pivot downwardly.

The disclosure of each patent cited herein whether or not done so specifically, is incorporated herein by reference.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A sign support system for supporting an associated graphic from a storage rack having first and second horizontal support members, the first and second horizontal support members defining a first plane, the sign support system, comprising:

a mounting member for mounting to the first horizontal support member, the mounting member having a shelf mount and a hinge portion, the mounting member configured such that when the mounting member is mounted to the first horizontal support member, the hinge portion is displaced from the first plane defined by the first and second horizontal support members;

an elongated arm member, the arm member having a hinge portion and a graphic support portion terminating at a free end, the hinge portion configured for pivotally mounting to the mounting member at the hinge portion for pivoting the sign between first and second positions; and adhering elements disposed on the elongated arm member at about the free end, wherein when in the first position the free end is disposed adjacent the second horizontal support member with the adhering elements engaging the second horizontal support member securing the arm member in the second position, and wherein when the adhering member is disengaged from the second horizontal support member, the arm member hinge portion is disposed between the mounting member and a vertical line extending from a center of gravity of the graphic and arm member such that graphic and arm member fall to the second position by the force of gravity.

2. The sign support system in accordance with claim 1 including a pair of mounting members and a pair of elongated arm members, each of the pair of mounting members associated with one of the pair of arm members.

3. The sign support system in accordance with claim 2 including transverse support members extending between the elongated arm members.

4. The sign support system in accordance with claim 1 wherein the adhering elements are magnetic elements.

5. The sign support system in accordance with claim 1 wherein the mounting members are formed as L-shaped brackets defining the shelf mount, each mounting member having a face portion and a rest portion and defining a juncture therebetween, the hinge portion extending from about the juncture.

6. The sign support system in accordance with claim 1 wherein each elongated arm member includes a flexible connecting portion extending between and connecting the hinge portion and the graphic support portion.

7. The sign support system in accordance with claim 6 wherein the hinge portion includes first and second flexing stops and a pivot stop.

8. The sign support system in accordance with claim 1 wherein the elongated arm member has a variable length.

9. The sign support system in accordance with claim 8 wherein the elongated arm member has a telescopic configuration.

10. The sign support system in accordance with claim 9 including fasteners to secure the elongated arm member at a desired length.

11. The sign support system in accordance with claim 6 wherein the elongated arm member hinge portion includes a cut-out region defining a portion of the flexible connecting portion.

12. A sign support system for use with an associated storage rack having lower and upper horizontal support members, the horizontal support members defining a first plane, the sign mounting system configured for mounting a sign thereto, comprising:

first and second spaced apart mounting members for mounting to the lower horizontal support member, the mounting members having a shelf mount having legs generally perpendicular to one another and a hinge portion, the mounting members configured such that when the mounting members are mounted to the lower horizontal support member, the hinge portion is displaced in a forwardly direction from the first plane defined by the horizontal support members;

an elongated arm member associated with each mounting member, each arm member having a hinge portion pivotally mounted to its respective mounting member and a graphic support portion extending from the hinge portion, the graphic support portions terminating at respective free ends, the hinge portions each configured for pivotal movement of the elongated arm member for pivoting the sign between upper and lower positions; and means for securing the elongated arm members in the upper position, wherein when in the upper position the free ends are disposed adjacent the upper horizontal support member and the means for securing the elongated arm members secures the arm members in the upper position, and wherein when the means for securing the arm members is disengaged from the upper horizontal support member, the arm member hinge portions are disposed between their respective mounting members and a vertical line extending from the center of gravity of the sign such that sign falls to the lower position by the force of gravity.

13. The sign support system in accordance with claim 12 including transverse support members extending between the elongated arm members.

14. The sign support system in accordance with claim 12 wherein the means for securing the elongated arm members in the upper position are adhering elements cooperating with the upper horizontal support member.

15. The sign support system in accordance with claim 14 wherein the adhering elements are magnetic elements.

16. The sign support system in accordance with claim 12 wherein the mounting members perpendicular legs define a face portion and a rest portion and further define a juncture therebetween, the hinge portion extending from about the juncture.

17. The sign support system in accordance with claim 12 wherein each elongated arm member includes a flexible connecting portion extending between and connecting the hinge portion and the graphic support portion.

18. The sign support system in accordance with claim 17 wherein the hinge portion includes first and second flexing stops and a pivot stop.

19. The sign support system in accordance with claim 12 wherein the elongated arm member has a variable length.

20. The sign support system in accordance with claim 12 wherein the elongated arm member has a telescopic configuration.

21. The sign support system in accordance with claim 20 including fasteners to secure the elongated arm member at a desired length.

22. The sign support system in accordance with claim 17 wherein the elongated arm member hinge portion includes a cut-out region defining a portion of the flexible connecting portion.

23. A sign support system for supporting an associated graphic from a storage rack having first and second horizontal support members, the first and second horizontal support members defining a first plane, the sign mounting system comprising:

a mounting member for mounting to the first horizontal support member, the mounting member having a shelf mount and a hinge portion, the mounting member configured such that when the mounting member is mounted to the first horizontal support member, the hinge portion is displaced from the first plane defined by the first and second horizontal support members;

an elongated arm member, the arm member having a hinge portion and a graphic support portion terminating at a free end, the hinge portion configured for pivotally mounting to the mounting member at the hinge portion for pivoting the graphic and elongated arm member between first and second positions;

means for connecting the arm member hinge portion and the graphic support portion; and adhering elements disposed on the elongated arm member at about the free end, wherein when in the first position the free end is disposed adjacent the second horizontal support member with the adhering elements engaging the second horizontal support member securing the arm member in the second position, and wherein when the adhering member is disengaged from the second horizontal support member, the arm member hinge portion is disposed between the mounting member and a vertical line extending from a center of gravity of the graphic and arm member such that graphic and arm member fall to the second position by the force of gravity.

24. The sign support system in accordance with claim 23 wherein the means for connecting the arm member hinge portion and the graphic support portion is flexible.

25. The sign support system in accordance with claim 23 including a pair of mounting members and a pair of elongated arm members, each of the pair of mounting members associated with one of the pair of arm members.

26. The sign support system in accordance with claim 23 wherein the hinge portion includes first and second flexing stops and a pivot stop.

27. The sign support system in accordance with claim 23 wherein the elongated arm has a variable length.

28. The sign support system in accordance with claim 27 wherein the elongated arm member has a telescopic configuration.

29. The sign support system in accordance with claim 28 including fasteners to secure the elongated arm member at a desired length.

30. The sign support system in accordance with claim 23 wherein the elongated arm member hinge portion includes a cut-out region defining a portion of the means for connecting the arm member hinge portion and the graphic support portion.

* * * * *